United States Patent [19]

Ahrens

[11] 4,296,923

[45] Oct. 27, 1981

[54] PLAYGROUND SWING

[75] Inventor: Paul W. Ahrens, Grinnell, Iowa

[73] Assignee: Miracle Recreation Equipment Company, Grinnell, Iowa

[21] Appl. No.: 84,053

[22] Filed: Oct. 11, 1979

[51] Int. Cl.[3] ..... A63G 9/00

[52] U.S. Cl. ..... 272/85

[58] Field of Search ..... 272/85, 86; 297/273-282

[56] References Cited

U.S. PATENT DOCUMENTS

| | | | |
|---|---|---|---|
| 1,870,748 | 8/1932 | Ramey | 272/85 |
| 2,545,295 | 3/1951 | Miller | 272/85 |
| 3,145,990 | 8/1964 | Prouty | 272/85 |
| 3,411,774 | 11/1968 | Thornton | 272/85 |
| 3,756,593 | 9/1973 | Lehr | 272/85 |
| 4,161,998 | 7/1979 | Trimble | 272/85 |

FOREIGN PATENT DOCUMENTS

| | | | |
|---|---|---|---|
| 2508922 | 9/1976 | Fed. Rep. of Germany | 272/85 |

*Primary Examiner*—Richard C. Pinkham
*Assistant Examiner*—T. Brown
*Attorney, Agent, or Firm*—Zarley, McKee, Thomte, Voorhees & Sease

[57] ABSTRACT

A swing unit suspended on a flexible line includes a circular seat portion to which an elongated upstanding centrally disposed stem is attached with the upper end of the stem being connected to the lower end of the flexible line. The swing unit is substantially rigid and the stem is sufficiently long for the user to pull on the stem and push on the seat to initiate the swinging motion.

1 Claim, 5 Drawing Figures

PLAYGROUND SWING

BACKGROUND OF THE INVENTION

Conventional swings involve a seat and possibly a back portion connected to a flexible line. The swinging motion is initiated by a person on the ground pushing the user of the swing or the user running along the ground and initiating the swinging motion before getting onto the seat of the swing. It is ordinarily not practical or at least easy to initiate the swinging motion from a still position while seated on the swing. It is thus desirable to have a swing seat unit that will allow for initiating the swinging motion while seated at a still position. It is also desirable to have a swing seat unit that is modernistic in appearance, inexpensive to manufacture, and one which utilizes modern synthetic materials which will have long life in terms of appearance and durability.

SUMMARY OF THE INVENTION

The swing unit of this invention includes a molded plastic integral body having a cylindrical seat portion integral with an upstanding centrally disposed stem which is substantially longer than the diameter of the seat such that it extends to at least the shoulders of the user so that he may comfortably pull on the stem while pushing in the opposite direction on the seat portion to activate the swinging motion from a standing or still position.

The body of the swing unit is hollow and includes a rod extending from the bottom side of the seat portion up through the stem where it terminates above the upper end of the stem in an eye element which is attached to the lower end of a flexible line such as a chain. The rod gives structural integrity to the swing unit and a large pressure plate is provided on the rod to bear against the bottom side of the seat portion.

DESCRIPTION OF THE PREFERRED EMBODIMENT

Figure 1:
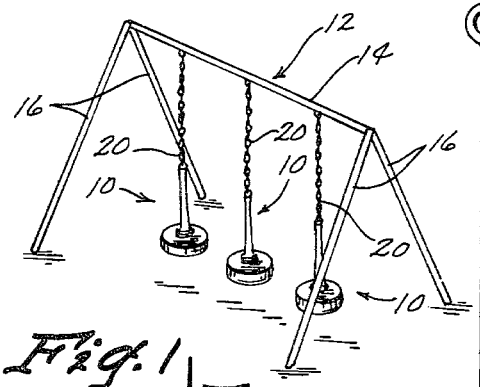
FIG. 1 is a perspective view of a swing set which includes the swing units of this invention.
Figure 2:
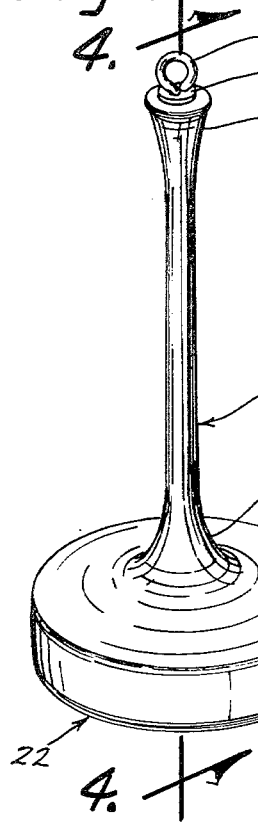
FIG. 2 is a perspective view of a swing unit only.
Figure 3:
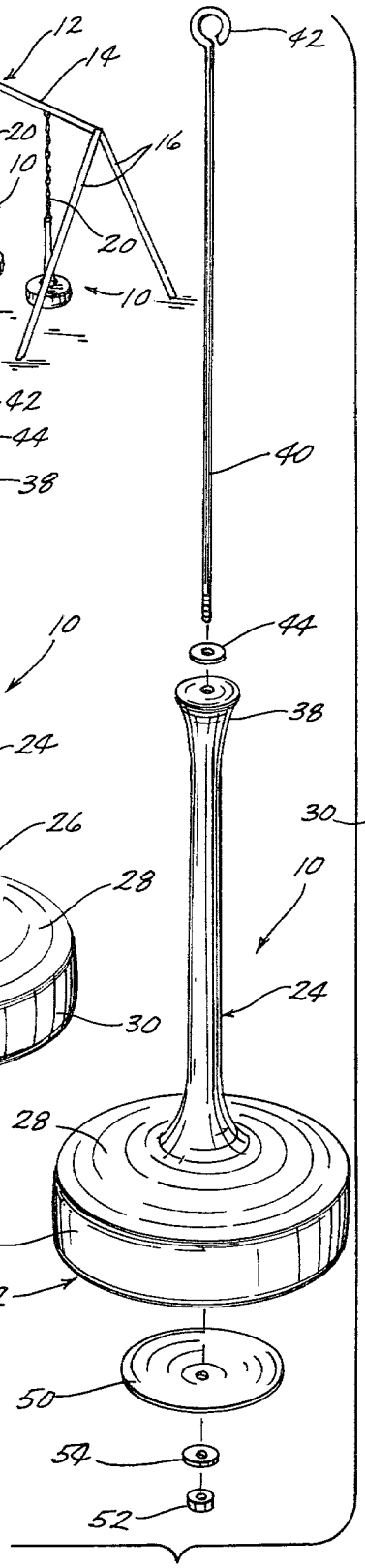
FIG. 3 is an exploded perspective view of the swing unit.
Figure 4:
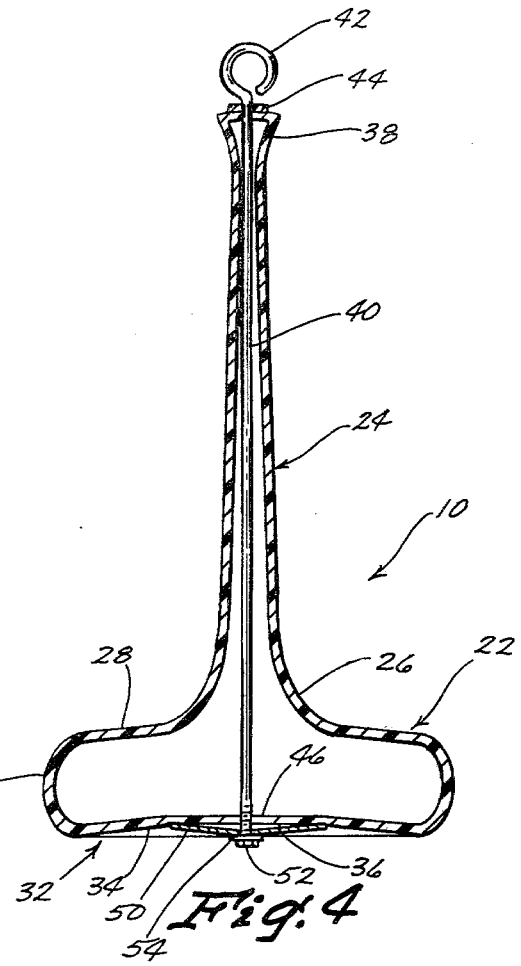
FIG. 4 is a cross-sectional view taken along line 4—4 in FIG. 2.
Figure 5:
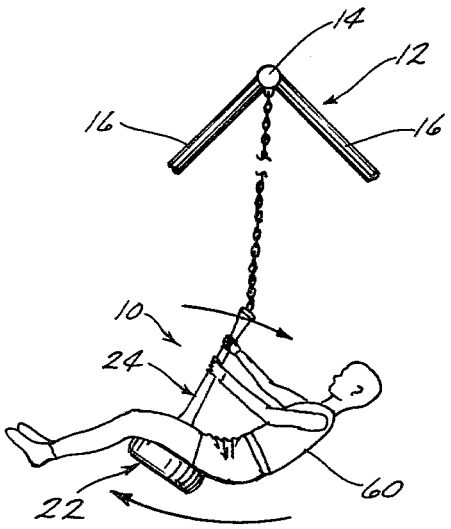
FIG. 5 is a fragmentary side elevational view of the swing unit in operation.

The swing unit of this invention is referred to generally by the reference numeral 10 in FIG. 1 and is seen on a swing set 12 having a horizontal bar 14 supported at its opposite ends by A-frame legs 16.

A flexible line 20, shown as a chain, depends from the bar 14 and is connected to the swing unit 10. The swing unit 10 includes a body including a cylindrical seat portion 22 from which an upstanding stem portion 24 is centrally positioned. The body is formed from high strength polyethylene plastic material molded into an integral one-piece unit. A gently-rounded surface 26 is formed at the juncture of the stem 24 to the top surface 28 of the seat unit 22. The seat unit also includes a rounded outer peripheral surface 30 which merges into a bottom generally flat surface 32 which is slightly concave as a result of an inwardly extending annular flat surface 34 merging into a flat centrally disposed surface 36 perpendicular to the stem 24.

The upper end of the stem 24 flares outwardly to form an enlarged portion 38 which strengthens the upper end of the stem 24 and also presents a stop for the user's hands to protect them from sliding onto the chain 20.

The stem 24 is elongated and substantially longer than the width or diameter of the seat portion 22 such that it will extend at least to the shoulder height of the user so that his hands may be comfortably placed on the stem directly in front of him for him to pull back on the stem while pushing out on the seat. to initiate the swinging action.

The seat unit is strengthened by an elongated rod 40 having an eye 42 on its upper end for attachment to the lower end of the chain 20. The rod extends through a washer 44 on the top of the stem, along the length of the stem 24 down through an aperture 46 in the center portion 36 of the bottom wall of the seat portion 22 where a concave upwardly pressure plate 50 is provided and held by a nut and washer 52 and 54, respectively. The pressure plate 50 is substantially the same size as the surface area of the flat annular surface 36 and thus distributes the load over a substantial area along the bottom side of the seat portion.

It is thus seen in operation that the person 60 is able to sit on the swing with his legs straddling the stem 24 while sitting on the top surface 28 of the seat portion 22. The stem extends upwardly to within convenient arm reach directly in front of him such that he may pull back on the stem while pushing out with his lower body against the seat 22 and thus moving his body to a more horizontal orientation in turn initiating the swinging movement since when he sits upright gravity will bring the swing unit back to a vertical position and past thus beginning the pendulum movement which can be amplified by further pulling and pushing timed with the back and forth swinging cycle.

I claim:

1. A playground swing comprising:

an elevated support;

a flexible line having upper and lower ends, and being connected at its upper end to said support;

an integral hollow plastic body including a seat unit and an upstanding stem, wherein said seat unit is substantially rigid, substantially circular in cross-section, and has a cylindrical seat portion with a flat top section including rounded upper and lower edges, and an outer convex peripheral surface, and being of a depth sufficient to allow the seat portion to be comfortably gripped between the user's thighs and the back of the user's legs to stabilize the user on said body during the operation of said swing, and wherein said upstanding stem is substantially rigid, fixably connected to and substantially centrally disposed on said seat portion cylindrical along its substantial length and flaring outwardly into said seat portion at its lower end, and outwardly into an enlarged portion at its upper end, and being substantially longer than the maximum dimensions of said seat portion, whereby a hand hold is provided for a user seated on said seat portion;

a pressure plate having a centrally disposed aperture and a nut means;

and a rod having an eyelet at one end and engaging the aperture and nut means at the other end, and extending from beyond the bottom of said seat portion through and beyond the length of said stem, and wherein said eyelet is connected to the lower end of said flexible line and said other end extends through the aperture of said pressure plate into engagement with said nut means to press said plate against the outer bottom surface of said seat portion, whereby a user pulls on said stem in a pumping action to initiate the swinging motion of the swing with said stem pivoting about a horizontal axis through said eyelet, thereby moving the swing out of the plane of the flexible line and at an angle to the vertical plane.

* * * * *